US006609465B2

(12) United States Patent
Kolavo

(10) Patent No.: US 6,609,465 B2
(45) Date of Patent: Aug. 26, 2003

(54) MULTIPLE PURPOSE TABLE

(76) Inventor: Frank Kolavo, 906 Gemini, Houston, TX (US) 77058

( * ) Notice: Subject to any disclaimer, the term of this patent is extended or adjusted under 35 U.S.C. 154(b) by 0 days.

(21) Appl. No.: 09/939,854

(22) Filed: Aug. 27, 2001

(65) Prior Publication Data

US 2003/0037709 A1 Feb. 27, 2003

(51) Int. Cl.[7] ..... A47B 37/00
(52) U.S. Cl. ..... 108/50.01
(58) Field of Search ..... 108/50.01, 50.02, 108/138, 147, 10; 312/223.3, 223.2, 223.1, 223.6

(56) References Cited

U.S. PATENT DOCUMENTS

| | | | | |
|---|---|---|---|---|
| 4,562,482 | A | | 12/1985 | Brown |
| 4,669,789 | A | | 6/1987 | Pemberton |
| 4,735,467 | A | | 4/1988 | Wolters |
| 4,766,422 | A | | 8/1988 | Wolters et al. |
| 4,828,342 | A | | 5/1989 | Stefan |
| 5,568,773 | A | * | 10/1996 | Hung |
| 5,680,820 | A | * | 10/1997 | Randolph |
| 5,797,666 | A | | 8/1998 | Park |
| 5,878,673 | A | * | 3/1999 | Kramer et al. |
| 5,957,059 | A | * | 9/1999 | Burham |
| 5,992,810 | A | * | 11/1999 | Crinion et al. |
| 6,029,580 | A | * | 2/2000 | Alfonso et al. |
| 6,038,986 | A | * | 3/2000 | Ransil et al. |
| 6,168,250 | B1 | | 1/2001 | Rogov |
| 6,269,753 | B1 | * | 8/2001 | Roddan |
| 6,283,047 | B1 | * | 9/2001 | Haller(-Hess) |
| 6,374,752 | B1 | * | 4/2002 | Walser |

FOREIGN PATENT DOCUMENTS

| | | | |
|---|---|---|---|
| DE | 3742959 | * | 6/1989 |

* cited by examiner

*Primary Examiner*—Jose V. Chen
(74) *Attorney, Agent, or Firm*—Kenneth A. Keeling; James E. Hudson, III

(57) ABSTRACT

A multiple purpose table having at least one fixed or moveable work surface, support walls and frame, and an adjustable arm for supporting a video display, which can retract into a protective storage well beneath one or more of said work surfaces. The adjustable arm is attached to the support walls below a work surface at a first end. A second end of the adjustable arm is attachable to the display. A display storage position of the multiple purpose table includes placing the adjustable arm second end and display below the work surface. A display access position of the multiple purpose table includes moving any work surface covering the storage position and raising the display, supported by the adjustable arm, into the user determined viewing position.

20 Claims, 3 Drawing Sheets

MULTIPLE PURPOSE TABLE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

This invention relates to tables or computer work stations for use in instructional interactive environments and more particularly to the mounting of a video display terminal in a concealed location when not in use, which is movable, by use of an adjustable support arm, to a user controlled, ergonomic, viewable position above the work surface when needed.

2. Description of the Related Art

Multiple purpose tables with stowed video display terminals are known to the prior art. The following patents illustrate such tables:

U.S. Pat. No. 4,562,482 disclosed a work station with computer screen recessed into the desk with screen offset from desk knee opening.

U.S. Pat. No. 4,669,789 disclosed a computer desk with top workspace pivotable upward with a monitor compartment supported below the top workspace.

U.S. Pat. No. 4,735,467 disclosed a stow-away screen mechanism for a video display concealed within the desk raised by a motor driven lift mechanism.

U.S. Pat. No. 4,766,422 disclosed a computer-integrated desk with video display terminal, keyboard, disc drives and printer completely concealed when not in use. This patent discloses raising of a flat screen video display, fixed at the rear of the desk, from beneath the work surface.

U.S. Pat. No. 4,828,342 disclosed a convertible computer desk that appears to be a conventional desk in a first position with an elevatable equipment platform to raise equipment to desktop level.

U.S. Pat. No. 5,797,666 disclosed a desk with liftable video display case that moves in a vertical direction between a display visible and a display nonvisible position.

U.S. Pat. No. 6,168,250 B1 disclosed a flat panel video display secured in a frame housing, allowing the display to be rotated 90° around a perpendicular axis through the screen, then rotated from a vertical to a horizontal position, for stowage in a drawer-type configuration within a desk.

The increased usage of computers and computer education, and the use of computers in classrooms, lectures and meetings have necessitated multiple purpose rooms, in which computer classes may be followed by a conventional lecture or a laboratory requiring drafting space. Either case requires a flat work surface for texts, written materials and conventional note-taking, along with an unobstructed view of the surrounding area. In other instances the room may require the use of video displays to support remote learning systems. Several methods have been attempted to resolve the need for tables that can support both computer and conventional use. Such methods have typically offered two distinct configurations, a flat work surface or a computer user station, while failing to adequately support integrating computers in an interactive classroom, meeting or lecture environment.

In some cases the table has been designed to incorporate a method for mechanically raising a video display from beneath the table, as taught by U.S. Pat. No. 4,828,342 issued to Stefan, U.S. Pat. No. 4,735,467 issued to Wolters, U.S. Pat. No. 4,766,422 issued to Wolters et al., and U.S. Pat. No. 5,797,666 issued to Park. However each of these requires a substantial mechanism to lift and lower the display. Such equipment requires regular maintenance, may be expensive, and may significantly impair a user's ability to see a presenter and substantial parts of the use area. Additionally, the computer configuration occupied a substantial part of the horizontal work surface, restricting the ability to use this space for laying out written materials, instructional manuals or conventional notes. In other cases the table has been designed to incorporate the video display below the surface of the tabletop, as taught by U.S. Pat. No. 4,669,789 issued to Pemberton on Jun. 2, 1987 and U.S. Pat. No. 4,562,482 issued to Brown on Dec. 31, 1995. However, U.S. Pat. No. 4,669,789 issued to Pemberton teaches a multiple purpose table which may not simultaneously be used as a conventional table and for computer use. U.S. Pat. No. 4,562,482 issued to Brown teaches use of a video display located below the work surface, which frustrates the ability of the user to view both the display and a presenter, or other activities in the use area, or to have written materials open on the work surface. Thus it would be beneficial to the prior art to provide a multiple purpose table with a stowed display, which would require little maintenance, be inexpensive, would not interfere with use of the primary work surface, and would not impair the user's clear view of the surrounding use area.

BRIEF SUMMARY OF THE INVENTION

Accordingly, objects of my invention are to provide, inter alia, a multiple purpose table with a stowable video display that:

- requires little maintenance;
- is inexpensive;
- easily converts from a computer table to a conventional table;
- provides an table-top workspace in both modes, and during transition; and
- while in computer table configuration, allows for an unobstructed view of the user's surroundings.

Other objects of my invention will become evident throughout the reading of this application. Individual embodiments of the invention may not provide each and every object identified in this application.

My invention is a multiple purpose table having at least one fixed or moveable work surface, support walls and frame, and an adjustable arm for supporting a display, which can retract into a protective storage well beneath one or more of said work surfaces. In embodiments of the invention possessing a plurality of fixed and adjustable work surfaces, such surfaces may or may not be generally co-planar. The adjustable arm is attached to the support walls or frame below said work surface at a first end. A second end of the adjustable arm is attachable to a display. A storage position of the multiple purpose table includes positioning said adjustable arm entirely below the work surface and positioning said work surface so it is functionally usable. Embodiments may include such positioning being within a protective storage well under a moveable work surface. A display access position of the multiple purpose table includes positioning the second end of the adjustable arm such that an attached display is at least partially visible above the work surface's horizontal position. Embodiments of the invention include a moveable work surface, which offers access to the display stowed within the storage well. The adjustable arm allows for a number of display positions in order to meet the user's ergonomic and viewing needs and preferences.

DETAILED DESCRIPTION OF THE INVENTION

Figure 1:
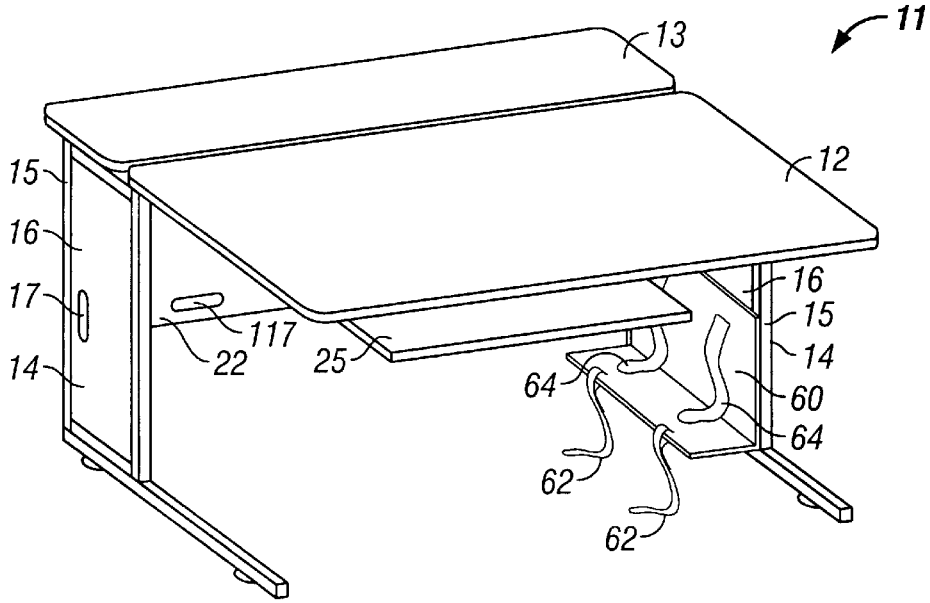
FIG. 1 is a perspective view of the multiple purpose table with a stowed display.

Referring first to FIG. 1, multiple purpose table 11 is shown configured as a conventional table. The exemplary embodiment includes a first work surface 12 and a second work surface 13 which are abutted to form the table top and which are co-planar. First work surface 12 is rigidly attached to two spaced, parallel table supports 14. Each table support 14 includes a support frame 15, in the exemplary embodiment, and a support wall 16. Second work surface 13 is movably attached to support frame 15.

Figure 2:
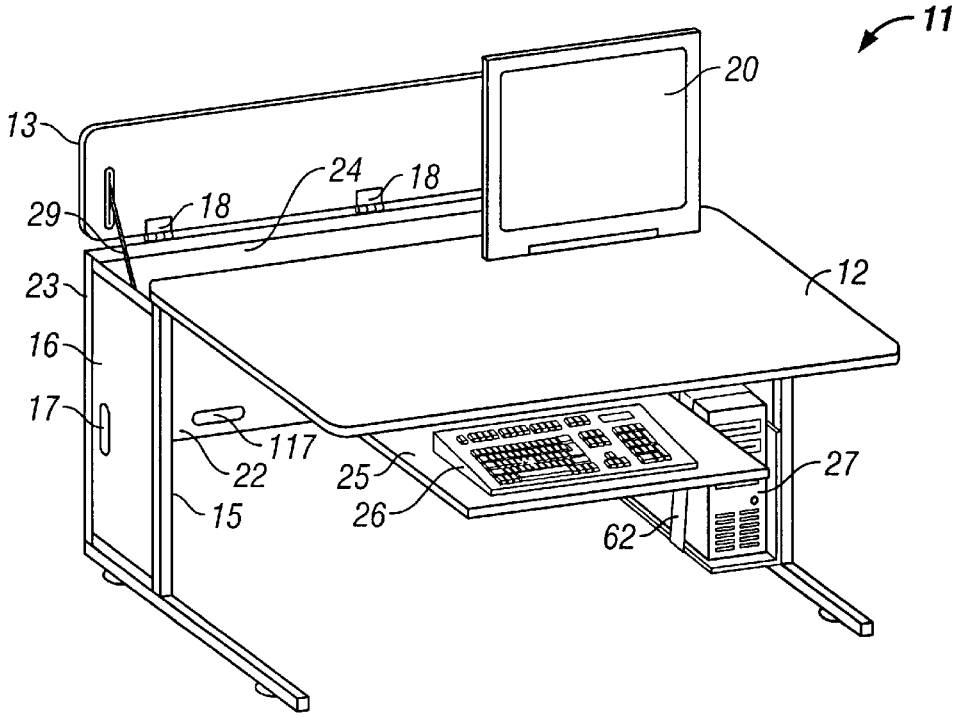
FIG. 2 is a perspective view of the multiple purpose table with a display raised for use.

Referring to FIG. 2, in the exemplary embodiment second work surface 13 is movably attached to support frame 15 by hinges 18 located on the rear edge of the support frame. Second work surface 13 may be rotated on hinges 18 between a closed position depicted in FIG. 1 and an open position depicted in FIG. 2. In the closed position of second work surface 13, multiple purpose table 11 is configured as a conventional table, and second work surface 13 forms work space which augments first work surface 12.

Referring to FIG. 2, a display 20 extends above first work surface 12. As used herein display can mean any type of video display. The exemplary embodiment utilizes a flat panel monitor, but other embodiments of a visual output device are within the subject matter of this invention. As described herein, the display 20 may be placed in various positions, including a storage position within a protective storage well below second work surface 13.

A first vertical panel 22 is attached to support frame 15 extending downward from the rear of first work surface 12. First vertical panel 22 is of sufficient strength to prevent any damage to display 20 from the legs of the table user when multiple purpose table 11 is configured as a conventional table.

A second vertical panel 24 is attached to support frame 15 extending downward at the table rear 23 of multiple purpose table 11. Second vertical panel 24 is of sufficient strength to prevent any damage to display 20 from passersby. First vertical panel 22 and second vertical panels 24 provides a traditional modesty panel for the benefit of the table user.

Support walls 16, first vertical panel 22 and second vertical panel 24, in combination define the display storage well for retaining and protecting the display 20 when the display 20 is not in use.

When multiple purpose table 11 is configured for use with the display, second work surface 13 is rotated to an upright position about hinges 18. Second work surface 13 is retained in such upright position by one or more lid stays 29.

Figure 3A:
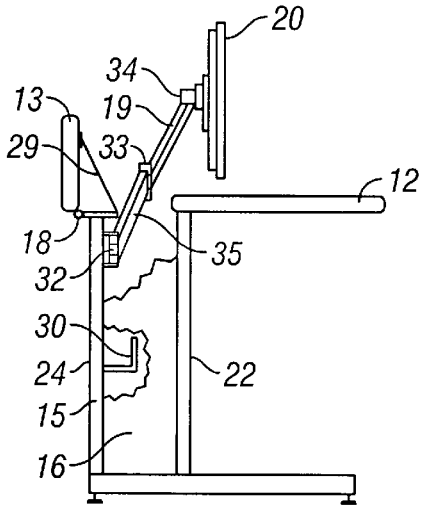
FIG. 3*a* is a partial cut-away side view of the multiple purpose table with a display raised for use.
Figure 3B:
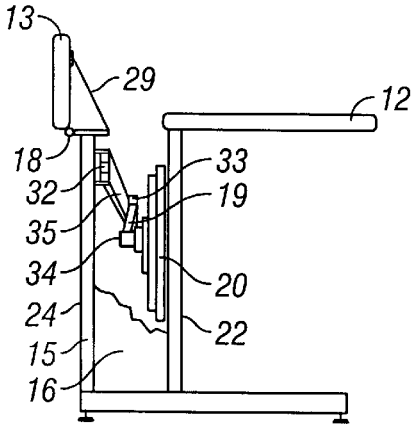
FIG. 3*b* is a partial cut-away side view of the multiple purpose table with a display stowed.
Figure 4:
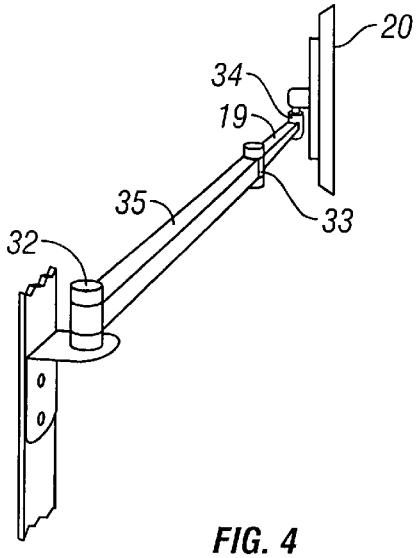
FIG. 4 is a perspective view of an exemplary adjustable arm.

Referring to FIGS. 3*a,* 3*b* and 4, an adjustable arm 19 is attached at arm first end 32 to support frame 15 and at arm second end 34 to display 20. Commercially-practiced flat panel displays have a threaded opening for a threaded attachment of a support provided at the rear of the display. In the exemplary embodiment, the arm second end 34 is configured to attach to a commercially-practiced flat panel display. The invention additionally anticipates other means of attachment.

In a storage position of display 20, the adjustable arm 19 is positioned such that the display 20 is located below second work surface 13 in a storage well defined by support walls 16, first vertical panel 22 and second vertical panel 24

In a position for use of the display 20, adjustable arm 19 is manually articulated to raise display 20. The user may manually adjust the height, lateral position, angle and tilt of display 20 to achieve a use location suitable to the individual user. In the exemplary embodiment, the arm first end 32 is fixedly attached to frame 15, such as by threaded connectors or welding, at a location with the storage well identified by support walls 16, first vertical panel 22 and second vertical panel 24.

Referring to FIGS. 1 and 2, a moveable tray 25 is positioned below first surface 12 and may be used to support a computer keyboard 26 or other data entry means. In a first keyboard storage position, moveable tray 25 is located entirely below first surface 12 and does not impede the use of multiple purpose table 11 as a conventional table. In a second keyboard operation position, moveable tray 25 is drawn outwardly from the first surface 12 to allow use of a keyboard 26, mouse, tablet or other accessory.

The exemplary embodiment also includes conveniences for location of the computer case and cabling. Referring to FIG. 1, a computer case support 60 is provided on support frame 15 proximate the base of the support frame 15. At least one strap 62 is attached to case support 60. At least one second strap 64 is attached to support frame 15 above each case support 60. Straps 62 and second straps 64 function in pairs, where each strap 62 may be attached to a corresponding second strap 64 by conventional means, such as buckles, hook and loop fasteners, or cinches. The computer case 27 may be placed on case support 60 and fixedly attached by straps 62 and second straps 64.

Still referring to FIGS. 1 and 2, a cable opening 17 is provided in support wall 16 so that computer, network, television, electrical and other connections may be run between the exterior of the table and the interior of the storage well defined by support walls 16, first vertical panel 22 and second vertical panel 24. Cable opening 117 is provided in first vertical panel 22 so that computer, network, television, electrical and other connections may be run between the exterior of the table, the interior of the storage well defined by support walls 16, first vertical panel 22 and second vertical panel 24, and the computer case 27.

Referring to FIG. 3*a,* a cable tray 30 is located on second vertical panel 24 to retain computer and electrical cables in an organized manner.

Referring to FIGS. 3*a,* 3*b* and 4, the adjustable arm 19 of the invention is depicted. Such adjustable arm is commercially available. An exemplary type of adjustable arm 19 is triple articulating with pivoting and tilt features that provides an ability to rotate the adjustable arm 19 about a vertical axis at the arm first end 32, provides vertical travel with arm segment 35, provide 360° rotation about a vertical axis at arm central connector 33, and provides both 360° rotation about a vertical axis and provide incline and decline tilt about a horizontal axis at the arm second end 34.

Referring to FIGS. 1, 2, 3*a* and 3*b,* to place the multiple purpose table 11 into display access position, the user lifts second work surface 13 to an open position, and engages lid stay 29. User then raises display 20, supported by the adjustable arm 19, into the selected viewing position. If needed, user can then draw out moveable tray 25 (not shown in FIGS. 3*a* and 3*b*) to the keyboard operation position. To return the table for conventional use, the user need only return moveable tray 25 (not shown in FIGS. 3*a* and 3*b*) to its keyboard storage position, if deployed, position adjustable arm 19 such that display 20 is below the plane of second work surface 13, release lid stay 29, and replace second work surface 13 to its work surface use position.

Figure 5:
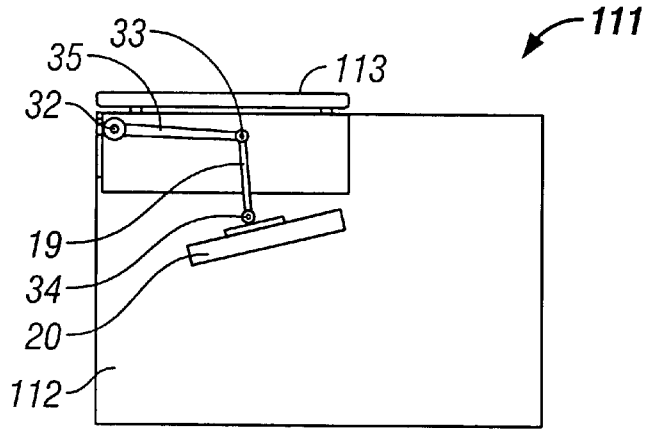
FIG. 5 is a top view of an embodiment of the multiple purpose table with a display raised for use.

Referring to FIG. 5, a top view of an alternate embodiment of the present invention is shown. A moveable work surface 113 of a multiple purpose table 111 does not extend the full width of the table 111. A work surface 112 extends to the full depth of the table 111 along a portion of the rear of table 111.

Figure 6:
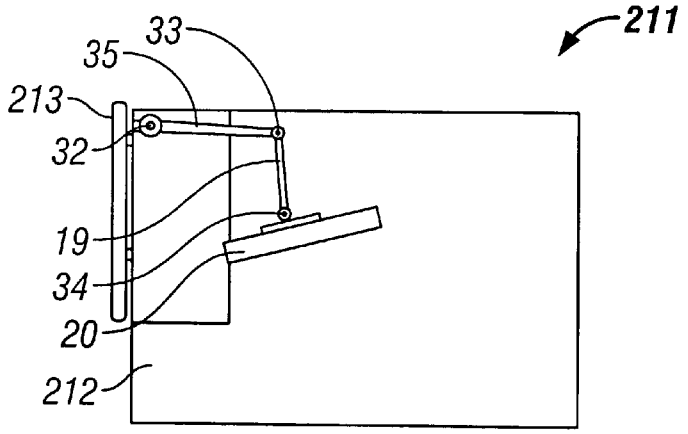
FIG. 6 is a top view of an embodiment of the multiple purpose table, placing the storage well along one side, with a display raised for use.

Referring to FIG. 6, a top view of an additional alternate embodiment of the present invention is shown. A moveable work surface 213 of a multiple purpose table 211 is positioned along a side of the table 211.

Figure 7:
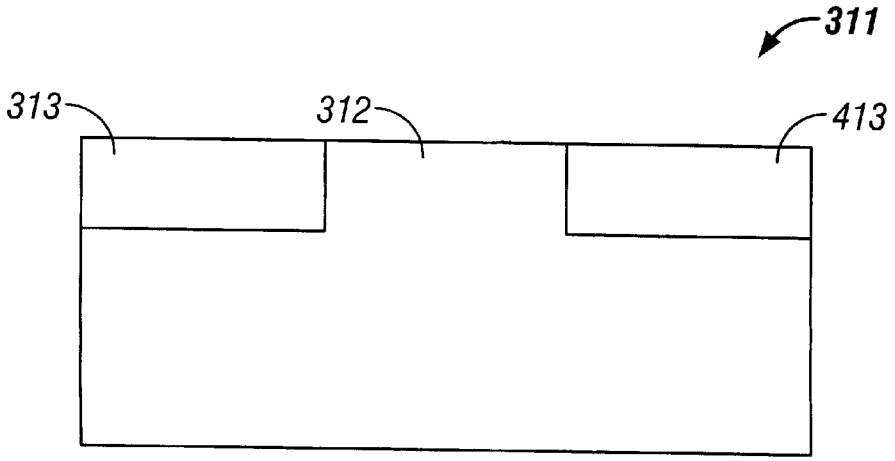
FIG. 7 is a top view of an embodiment of the multiple purpose table, supporting multiple storage wells, with the displays stowed.

Referring to FIG. 7, a top view of an additional alternate embodiment of the present invention is shown. The embodiment of FIG. 7 provides two moveable work surfaces 313 and 413 each extending from a table end with a fixed work surface 312 sized to mate with the two moveable work surfaces 313 and 413. The embodiment of FIG. 7 allows for use by two users of a multiple purpose table 311 having two displays (not shown), two keyboards (not shown) and two computers (not shown).

The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

I claim:

1. A table comprising:

a support means;

a work surface and a movable surface attached to said support means;

an adjustable arm having a first end and a second end;

said first end of said adjustable arm attached to said support means at a level below said movable surface;

said second end of said adjustable arm for holding a display;

said second end of said adjustable arm moveable to a display storage position where the display is wholly below the work surface;

said second end of said adjustable arm moveable vertically and horizontally to a display access position where display is at least partially above the work surface; and said display access position adjustable to a user selected viewing position.

2. The table as described in claim 1 wherein:

said work surface has a front edge and a rear edge;

said support means structured to accommodate a seated user at said front edge of said work surface; and said first end of said adjustable arm positioned distal said front edge so as to accommodate a seated user at said front edge.

3. The table as described in claim 1 wherein:

said adjustable arm is a pneumatic arm capable of supporting said display in a number of display positions.

4. The table as described in claim 3 wherein:

said work surface has a front edge and a rear edge;

said support means structured to accommodate a seated user at said front edge of said work surface; and said first end of said adjustable arm positioned distal said front edge so as to accommodate a seated user at said front edge.

5. A table comprising:

a support means for supporting a first surface and at least one moveable surface;

said first surface and said moveable surface attached to said support means;

an adjustable arm having a first end and a second end;

said first end of said adjustable arm fixedly attached to said support means at a level below either of said first surface or said moveable surface;

said second end of said adjustable arm for holding a display;

said first surface is available as a stable work surface during movement of said adjustable arm and said at least one moveable surfaces;

said moveable surface and said adjustable arm moveable to a display storage position wherein each of said moveable surface and said first surface are functionally useable as work surfaces, and said adjustable arm and said display are positioned below either of said first surface or said moveable surface;

said moveable vertically and horizontally surface and said adjustable arm moveable to a display access position wherein said adjustable arm positioned at a display viewing position wherein said display at least partially above said first surface; and said display access position adjustable to a user selected viewing position.

6. The table comprising:

a support means for supporting a first surface and at least one moveable surface;

said first surface attached to said support means;

said moveable surface is hingedly attached to said support means;

an adjustable arm having a first end and a second end;

said first end of said adjustable arm fixedly attached to said support means at a level below either of said first surface or said moveable surface;

said second end of said adjustable arm for holding a display.

said first surface, said moveable surface, and said adjustable arm moveable to a display storage position wherein each of said moveable surface and said first surface are functionally useable as work surfaces, and said adjustable arm and said display are positioned below either of said first surface or said moveable surface; and said moveable surface and said adjustable arm moveable to a display access position wherein said adjustable arm positioned at a display viewing position wherein said display at least partially above said first surface.

7. The table as described in claim 6 further comprising:

a keyboard tray located below and attached to said first surface; and said keyboard tray moveable between a stored position wherein the keyboard tray is substantially covered by said first surface and a use position wherein at least a portion of said keyboard tray is not covered by said first surface.

8. The table as described in claim 7 further comprising:

a computer case support means attached to said support means; and said computer support means comprising at least one ledge attached to said support means and at least one strap attached to said computer support means for supporting a computer case.

9. The table as described in claim 6 further comprising:

a keyboard tray located below and attached to said first surface; and said keyboard tray moveable between a stored position wherein the keyboard tray is substantially covered by said first surface and a use position wherein at least a portion of said keyboard tray is not covered by said first surface.

10. The table as described in claim 9 further comprising:

a computer case support means attached to said support means; and said computer support means comprising at least one ledge attached to said support means and at least one strap attached to said computer support means for supporting a computer case.

11. The table as described in claim 6 further comprising:

a display storage well for receiving said display located below either or both of said first surface and said moveable surface;

said storage well comprising of either or both said support walls or a vertical panel, enclosing the sides of the area occupied by the display and adjustable arm while in the display storage position; and said first end of adjustable arm fixedly attached to said support means or either said vertical panel, within said display storage well.

12. The table as described in claim 11 wherein:

said moveable surface is hingedly attached to support means.

13. The table as described in claim 12 further comprising:

a keyboard tray located below and attached to said first surface; and said keyboard tray moveable between a stored position wherein the keyboard tray is substantially covered by said first surface and a use position wherein at least a portion of said keyboard tray is not covered by said first surface.

14. The table as described in claim 13 further comprising:

a computer case support means attached to said support means; and said computer support means comprising at least one ledge attached to said support means and at least one strap attached to said computer support means for supporting a computer case.

15. The table as described in claim 14 further comprising:

a cable access opening in said first vertical panel, said second vertical panel or said support means.

16. The table as described in claim 11 further comprising:

a keyboard tray located below and attached to said first surface; and said keyboard tray moveable between a stored position wherein the keyboard tray is substantially covered by said first surface and a use position wherein at least a portion of said keyboard tray is not covered by said first surface.

17. The table as described in claim 16 further comprising:

a computer case support means attached to said support means; and said computer support means comprising at least one ledge attached to said support means and at least one strap attached to said computer support means for supporting a computer case.

18. The table as described in claim 17 further comprising:

a cable access opening in at least one of said first vertical panel, said second vertical panel or said support means.

19. The table as described in claim 5 further comprising:

a display storage well for receiving said display located below at least one of said first surface and said moveable surface;

said storage well comprising at least one of said support walls and a vertical panel, enclosing the sides of the area occupied by the display and adjustable arm while in the display storage position; and said first end of adjustable arm fixedly attached to at least one of said support means and said vertical panel, within said display storage well.

20. The table as described in claim 5 wherein:

said moveable surface is hingedly attached to support means.

* * * * *

UNITED STATES PATENT AND TRADEMARK OFFICE

CERTIFICATE OF CORRECTION

PATENT NO. : 6,609,465 B2
APPLICATION NO. : 09/939854
DATED : August 26, 2003
INVENTOR(S) : Frank Kolavo It is certified that error appears in the above-identified patent and that said Letters Patent is hereby corrected as shown below:

Column 6, line 41, delete the text “vertically and horizontally”.
Column 6, line 42, insert after “adjustable arm moveable” the text -- vertically and horizontally --.
Column 6, line 60, the text “display.” should read -- display; --.

Signed and Sealed this

Fifth Day of May, 2009

JOHN DOLL
*Acting Director of the United States Patent and Trademark Office*